United States Patent [19]

Gregory

[11] Patent Number: 4,960,235

[45] Date of Patent: Oct. 2, 1990

[54] NAIL SET DEVICE

[76] Inventor: Glenn R. Gregory, 557 Moosetrot Ave., Fairbanks, Ak. 99712

[21] Appl. No.: 439,157

[22] Filed: Nov. 20, 1989

[51] Int. Cl.[5] ..... B25C 3/00

[52] U.S. Cl. ..... 227/147; 81/44

[58] Field of Search ..... 227/147, 212 F; 81/44; 30/DIG. 6

[56] References Cited

U.S. PATENT DOCUMENTS

| | | | |
|---|---|---|---|
| 2,161,969 | 6/1939 | Mange | 30/DIG. 6 |
| 2,666,201 | 1/1954 | Van Orden | 227/147 |
| 2,727,235 | 12/1955 | Cameron | 227/147 |
| 2,783,799 | 3/1957 | Hart | 81/44 |
| 2,866,974 | 1/1959 | Hoffman | 81/44 |
| 3,060,440 | 10/1962 | Pfaff et al. | 227/147 |
| 3,847,193 | 11/1974 | Brunstetter | 81/44 |

*Primary Examiner*—Douglas D. Watts

*Assistant Examiner*—John M. Husar

*Attorney, Agent, or Firm*—Leon Gilden

[57] ABSTRACT

A nail set device is set forth wherein a housing comprises a central cylindrical cavity extending interiorly of the housing from one end to receive a punch therewithin. The housing is formed with a forward planar wall with an axial bore extending from the planar wall through the other end of the housing axially aligned with the cylindrical cavity. The punch includes a reduced section to receive an abutment screw to control axial punch travel within the housing. A forwardly mounted return spring between the conical forward wall and a central enlarged diameter portion of the punch maintains the punch in a retracted orientation relative to the housing. A forward resilient bumper is mounted overlying the forward reduced circular section of the housing to minimize damage to an associated work surfaces.

1 Claim, 1 Drawing Sheet

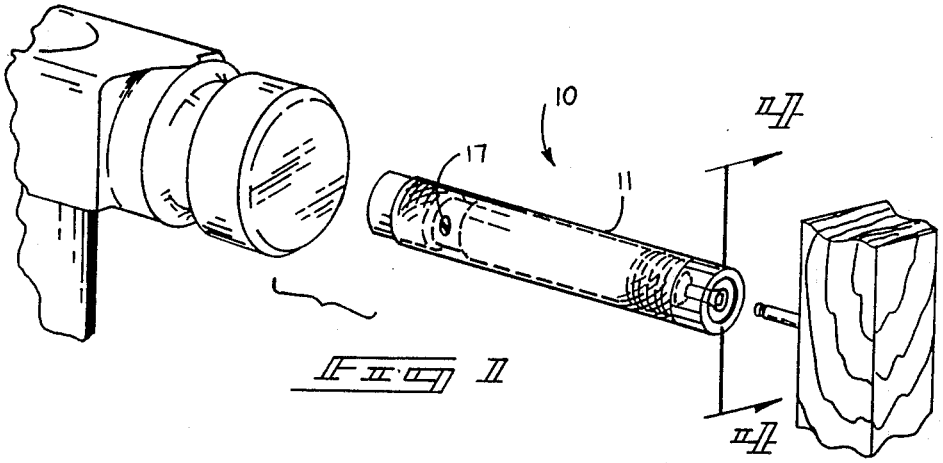
FIG 1
FIG 2
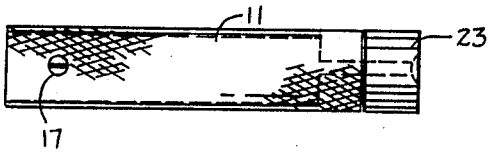
FIG 5
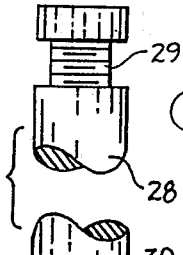
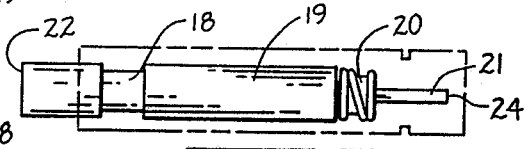
FIG 3
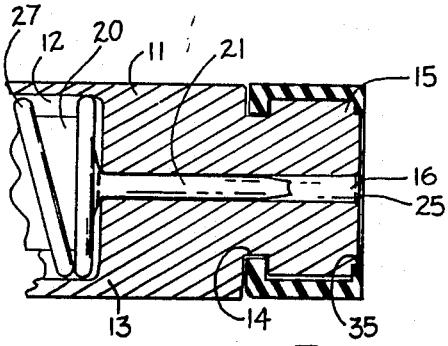
FIG 4

NAIL SET DEVICE

BACKGROUND OF THE INVENTION

1. Field of the Invention

The field of invention relates to nail sets, and more particularly pertains to a new and improved nail set device to receive and drive nails below a working surface minimizing damage to said surface.

2. Description of the Prior Art

The prior art has utilized nail sets in various forms to direct a nail protruding above a working surface to a depth below the surface and in this regard, nail sets of the prior art have frequently imparted damage to the working surface upon directing a blow to a central punch of a typical nail set device. For example, U.S. Pat. No. 1,575,582 to Joy sets forth a nail driver and set utilizing a typical central cavity including a solid punch to present a nail interiorly of a working surface.

U.S. Pat. No. 1,688,130 to Olsen sets forth a nail set including a generally bifurcated leg structure with roller-type surfaces slidingly positionable over a working surface with a central nail set. The Olsen patent is of &he typical prior art enabling marring and disfigurement of working surfaces when utilized.

U.S. Pat. No. 1,289,526 to Nye sets forth a rivet set utilizing a captured spring with a rearwardly oriented punch positioned within a central housing, but as is typical of &he prior art fails to provide means to minimize disfigurement of a working surface.

U.S. Pat. No. 356,666 to Shattuck sets forth an awl with a conventional plunger positioned within a solid housing, which is typical of the prior art failing to provide a bumper or shock absorbing mechanism forwardly of the device.

U.S. Pat. No. 462,565 to Lewis sets forth a tack set wherein a generally "L" shaped plunger is received within an elongate housing to enable tacks to be directed through an angularly offset leg or magazine, but utilizes a conventional solid housing organization enabling disfigurement and marring of working surfaces.

As such, i& may be appreciated that there is a continuing need for a new and improved nail set device which addresses both the problems of ease of use and effectiveness in organization, and in this respect, the present invention substantially fulfills this need.

SUMMARY OF THE INVENTION

In view of the foregoing disadvantages inherent in the known types of nail set devices now present in the prior art, the present invention provides a nail set device wherein the same minimizes disfigurement of a working wood surface when utilized in directing nails below the surface by employing shock absorbing mechanisms forwardly of the housing of the apparatus. As such, the general purpose of the present invention, which will be described subsequently in greater detail, is to provide a new and improved nail set device which has all the advantages of the prior ar& nail set devices and none of the disadvantages.

To attain this, the present invention comprises an elongate cylindrical housing including a punch contained therein with the punch provided with a reduced section to receive an abutment screw to control length of travel of the punch within the housing. A replaceable forwardly positioned cylindrical bumper is securable onto a forward projection of the housing wherein the bumper is of a diameter substantially equal to that of the housing body. A modification of the instant invention utilizes a solid punch body with a forwardly directed punch projection positionable and reciprocal within a sleeve that is positioned within a forward axial bore of the housing to enable utilization of punches of reduced diameter to accommodate reduced diameter nails therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, maY readilY be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application The abstract is neither intended to define the invention of the application, which is measured by &he claims, nor is it intended to be limiting as to the scope of the invention in any way.

It is therefore an object of the present invention to provide a new and improved nail set device which has all the advantages of the prior art nail set devices and none of the disadvantages.

It is another object of the present invention to provide a new and improved nail set device which may be easily and efficiently manufactured and marketed.

It is a further object of the present invention to provide a new and improved nail set device which is of a durable and reliable construction.

An even further object of the present invention is to provide a new and improved nail set device which is susceptible of a low cost of manufacture with regard to both materials and labor, and which accordingly is then susceptible of low prices of sale to the consuming public, thereby making such nail set device economically available to the buying public.

Still yet another object of the present invention is to provide a new and improved nail set device which provides in the apparatuses and methods of the prior art some of the advantages thereof, while simultaneously overcoming some of the disadvantages normally associated therewith.

Still another object of the present invention is to provide a new and improved nail set device wherein the same employs replaceable shock absorbing mechanisms to a forward portion of the punch housing to minimize marring and disfigurement of a working surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic view taken in elevation of the instant invention.

FIG. 3 is an orthographic view taken in elevation of the punch body of the instant invention.

FIG. 4 is an orthographic view, taken along the lines 4—4 of FIG. 1, in the direction indicated by the arrows.

FIG. 5 is an orthographic view of a modified punch body of the instant invention.

DESCRIPTION OF THE PREFERRED EMBODIMENT

With reference now to the drawings, and in particular to FIGS. 1 to 5 thereof, a new and improved nail set device embodying the principles and concepts of the present invention and generally designated by the reference numeral 10 will be described.

More specifically, the nail set device 10 of the instant invention essentially comprises a cylindrical housing 11 formed with a cylindrical central cavity 12 extending from a rearwardmost end of the housing 11 to a forwardmost conical forward wall 13 formed within the housing remote from a forward end of the housing. A circular groove 14 is positioned and formed orthogonally relative to the axial center line of the housing 11 spaced between the conical wall 13 and a forward end of the housing 11 positioned forwardly of the groove 14 is a forward cylindrical boss 15 of a diameter less than that of the diameter of the housing body 11 rearwardly of the groove 14 a predetermined thickness. An axial bore 16 extends from the conical forward wall 18 forwardly through the forward end of the housing 11 and terminated in a chamfered end 25 about the opening to minimize debris and the like from seizing the plunger 21 reciprocatably mounted therethrough. "L" shaped top groove 35 is formed to the remote forward end of the box 15 to receive a forward annular flange of a polymeric bumper 23. An abutment screw 17 is directed diametrically through a side wall of the housing 17 to cooperate with a reduced cylindrical section 18 formed within the reciprocating punch 19 positioned within the housing 11. The punch 19 is formed with a forward tapered, or reduced cross-sectional area nose 20 of complementary configuration to that of the forward wall 13 with an axially forwardly directed plunger 21 slidingly receivable within the axial bore 16. The free end of the plunger 21 including a portion at least one-fourth inch defining a reduced tapered end to minimize a sticking of the plunger 21 within a workpiece. Furthermore, &he plunger 21 defines a concave tip 24 to enhance securement to an associated nail head. The strike barrel 22 formed rearwardly of the reduced cylindrical section 18 extends outwardly of the housing 11 whereupon striking of the strike barrel 22 by a hammer, as illustrated in FIG. 1, directs the plunger 21 along the axial bore 16 to direct a nail, as illustrated FIG. 1, below the working surface of the workpiece. The encircling polymeric bumper 23 of the aforenoted predetermined thickness is secured about the forward cylindrical boss 15 within grooves 14 and 35 wherein the bumper of the predetermined thickness to equal the diameter of the housing 11 when secured about the forward cylindrical boss 15. The bumpers 23 is formed with an inwardly directed circular flange received within the groove 14 and of a length substantially equal to the depth of the groove 14 to retain &he bumper onto the boss 15. Groove 35 is of a height to receive an upper annular flange of the bumper 28 and to effect projection of a forward surface of the bumper beyond a forward surface of the boss 15. As the bumper 28 is symmetrical, it may be removed and its flanges reversed within respective grooves 14 and 85 to effectively double an effective life cycle of the bumper 23 in use. A return spring 27 is captured between the conical forward wall 13 and the punch body 19 to maintain the punch in a retracted position to enable immediate recycling of the punch onto subsequent nails to be driven. The bumper 23 is readilY replaceable as they minimize disfigurement and marring of a working surface and as illustrated in FIG. 4, extend forwardly of the forward end of the housing 11 and are of a compressible polymeric material to minimize impact of the device onto a working surface.

FIG. 5 is illustrative of a further punch 28 provided with a reduced rearward section 29 with a blunt forward face 30. The blunt forward face 30 receives a cylindrical punch plate 31 with an orthogonally and forwardly extending plunger shaft 32. The plunger shaft 32 is of a reduced diameter relative to that of the plunger 21 and accordingly, a sleeve 38 of an external diameter substantially equal to that of the internal diameter of the axial bore 16 is received within the axial bore 16 with a capture spring plate 84 orthogonally secured to the sleeve 33 with the sleeve 33 provided with an internal bore substantially equal to that of the plunger shaft 32. In this manner, various plunger shafts 32 and associated plunger plates 31 may be utilized in association with various sleeves 38 to accommodate diameters of nails to be driven less than that to be accommodated by the plunger 21.

As to the manner of usage and operation of the instant invention, the same should be apparent from the above description. Accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious &o one skilled in the art, and all equivalent relationships to those illustrated in the drawings and described in &he specification are intended to be encompassed by the present invention.

Therefore, the foregoing is considered as illustrative only of &he principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of &he invention.

What is claimed as being new and desired to be protected by Letters Patent of the United States is as follows:

1. A nail set device comprising in combination, an elongate cylindrical housing including a first cylindrical bore extending interiorly and axially of said housing and terminating in a forward planar wall with a second cylindrical bore extending from said forward planar wall through to a further end of said housing axially aligned with said first cylindrical bore, and a punch of a length greater than that of said first bore axially receivable and slidable within said first cylindrical bore and including a forward conical nose and of complementary configuration to said planar wall with a plunger extending axially and forwardly of said conical nose and receivable within said second cylindrical bore and of a length greater than that of said cylindrical bore, and shock impact means secured to said housing and extending forwardly of said further end for receiving impact of said housing upon a work surface, and wherein said punch includes a first reduced diameter portion spaced from a free end of said punch extending rearwardly of said housing wherein said first reduced diameter portion is of a diameter less than that of said first cylindrical bore and receives an adjustment screw therewithin wherein said adjustment screw is threadedly received within said housing to limit reciprocation of said punch within said housing, and wherein a return spring is captured between said planar wall and a main body of said punch to maintain said punch in a retracted position, and wherein said shock impact means includes a polymeric bumper, said polymeric bumper including a first circular flange, said first directed flange receivable within a first circular groove formed within said cylindrical housing spaced from said forward end and said bumper including a second inwardly directed flange receivable within a second circular "L" shaped groove formed within adjacent terminal end of said further end, and said second "L" shaped groove defined by a predetermined height less than that defined by a predetermined thickness of said second flange to project said second flange forwardly of said further end, and the cylindrical housing formed rearwardly of said groove and said further end is of a further diameter less than that of an external diameter by said housing, and said polymeric bumper defining a cylindrical body between the first and second circular flanges to permit removal and reversal of the bumper relative to the first and second "L" shaped grooves, said bumper is of a thickness substantially equal to the difference between the external diameter of the housing and the further diameter of said further end.

* * * * *